US006200678B1

(12) United States Patent
Hunt et al.

(10) Patent No.: US 6,200,678 B1
(45) Date of Patent: Mar. 13, 2001

(54) CORROSION RESISTANT COATED METAL STRAND

(75) Inventors: Frederick F. Hunt, Jacksonville, FL (US); Donald J. Gillette, Guilford, CT (US)

(73) Assignee: Florida Wire & Cable, Inc., Jacksonville, FL (US)

( * ) Notice: Subject to any disclaimer, the term of this patent is extended or adjusted under 35 U.S.C. 154(b) by 0 days.

(21) Appl. No.: 08/470,415

(22) Filed: Jun. 6, 1995

Related U.S. Application Data

(63) Continuation of application No. 07/960,276, filed on Oct. 13, 1992, now abandoned, which is a continuation of application No. 07/655,282, filed on Feb. 14, 1991, now abandoned, which is a continuation of application No. 07/368,097, filed on Jun. 19, 1989, now abandoned, which is a continuation of application No. 07/094,770, filed on Sep. 10, 1987, now abandoned, which is a continuation of application No. 06/937,008, filed on Dec. 2, 1986, now abandoned, which is a continuation of application No. 06/830,495, filed on Feb. 19, 1986, now abandoned, which is a continuation of application No. 06/437,274, filed on Oct. 28, 1992, now abandoned.

(51) Int. Cl.[7] ..... E04C 5/00; D07B 1/00

(52) U.S. Cl. ..... 428/371; 428/372; 428/377; 428/379; 428/380; 427/461; 427/185; 427/195; 427/201; 427/202; 427/204; 427/205; 427/385.5; 427/386; 427/409; 427/410; 264/228; 52/233.14

(58) Field of Search ..... 427/459, 461, 427/185, 195, 201, 202, 203, 204, 205, 385.5, 386, 409, 410, 419.1, 421; 264/228; 428/371, 372, 377, 379, 380; 52/223.14

(56) References Cited

U.S. PATENT DOCUMENTS 3,566,833 * 3/1971 Beebe ..... 118/634
4,104,416 * 8/1978 Parthasarathy ..... 427/29
4,147,737 * 4/1979 Sein ..... 427/461

FOREIGN PATENT DOCUMENTS

894945 * 4/1962 (DE) .
894946 * 8/1959 (GB) .
2944878 * 5/1981 (GB) .

OTHER PUBLICATIONS

DOT Fed. Hwy. Administration Memorandum, "Corrosion Protection of Reinforcement in Bridge Decks", Feb. 10, 1981.*

DOT Fed. Hwy. Administration Memorandum, "Corrosion Protection of Reinforcement in Bridge Decks", Apr. 14, 1981.*

ASTM Designation: D 3963–81, "Epoxy Coated Reinforcing Steel".*

ASTM Designation: A 775–81, "Epoxy Coated Reinforcing Bars".*

ASTM Designation: A 882/A 882M–91a, "Epoxy–Coated Seven–Wire Prestressing Steel Strand".*

* cited by examiner

*Primary Examiner*—Richard Bueker
(74) *Attorney, Agent, or Firm*—William H. Holt

(57) ABSTRACT

Concrete strengthening members, particularly prestressing tendons such as strands of steel wire, are provided with a strongly adherent plastic coating which may be substantially impermeable for improved corrosion resistance, and/or which may have embedded therein abrasive or grit-form particles to provide improved bond with the concrete, and particularly to provide controllable bond transfer in prestressing tendons of the pre-tensioned type. The plastic coating preferably is applied electrostatically in powder form, and fusion bonded by heat. The abrasive can be applied by spraying during a viscous state of the heated resin, and can be varied as to size and spacing density so as to control the surface condition and the bonding effect. Fusion and curing heat may come from preheating of the member before application of the resin powder, which preferably is a heat curable, thermosetting epoxy. Coating thickness and grit application are readily variable to meet particular requirements. Particularly advantageous results are achievable for high strength steel strands for prestressing concrete by pretensioning, facilitating their use where previously considered impractical or impossible.

16 Claims, No Drawings

CORROSION RESISTANT COATED METAL STRAND

This is a continuation of application Ser. No. 07/960,276 filed Oct. 13, 1992, abandoned which is a continuation of application Ser. No. 07/655,282 filed Feb. 14, 1991, abandoned, which is a continuation of application Ser. No. 07/368,097 filed Jun. 19, 1989, abandoned, which is a continuation of application Ser. No. 07/094,770 filed Sep. 10, 1987, abandoned, which is a continuation of application Ser. No. 06/937,008 filed Dec. 2, 1986, abandoned, which is a continuation of application Ser. No. 06/830,495 filed Feb. 19, 1986, abandoned, which is a continuation of application Ser. No. 06/437,274 filed Oct. 28, 1982, abandoned.

FIELD OF THE INVENTION

This invention relates to steel members for strengthening concrete, particularly prestressing tendons of wire and strand types for prestressing by pretensioning or posttensioning, but applicable in some respects to reinforcing bars, wires, or the like. The invention more particularly relates to improvements in corrosion resistance and/or bond control of such members.

BACKGROUND

Corrosion of steel strengthening members in concrete has long been a problem in the art, and has received a great deal of attention. For instance, it is known to coat reinforcing bars with an epoxy coating applied by electrostatic spray guns, and the American Society for Testing and Materials has issued standard specifications for epoxy-coated reinforcing bars and steel, under ASTM designations A 775-81 and D 3963-81, covering deformed and plain steel reinforcing bars with protective epoxy coating applied by the electrostatic spray method. This approach is not without its problems in that the coating thickness is specified as 5 to 12 mils, apparently in order to avoid bond problems encountered at greater thicknesses, and the lesser thicknesses involve problems of integrity or permeability of the coating, exemplified by the ASTM specifications permitting two holidays (pin holes not discernible to the unaided eye) per linear foot of the coated bar. Epoxy coating materials are available on the market for use specifically in coating reinforcing bars. A problem remains, however, in assuring an adequate corrosion-protective coating while maintaining good bonding qualities with the concrete.

Corresponding problems, but of greater magnitude and importance, exist in the case of high strength steel wire and strand used for prestressing concrete (hereafter referred to as PC wire or strand). Strand, of course, is formed by spinning a number of wires (typically six) together around a central core. The magnitude of the problem is exemplified by the fact that use of PC strand or wire is discouraged or prohibited in certain areas where it advantageously could be used. Thus, in a Memorandum dated Feb. 10, 1981, of the Federal Highway Administration, U.S. Department of Transportation, captioned "Corrosion Protection of Reinforcement in Bridge Decks," and dealing with criteria to be applied to all reinforcement in bridge decks, prestressed or otherwise, where deicing salts or a salt water environment present the potential for corrosion, it is suggested that all conventional reinforcement be epoxy coated, but that "Pretensioning should not be permitted in bridge decks since there is no known way of eliminating the potential for corrosion," and that "Polyethylene ducts should be provided for protection of posttensioned tendons in addition to grouting." In a follow-up Memorandum dated Apr. 14, 1981, indicating that epoxy coating of rebars was not intended to be the only method of corrosion protection of bridge decks, it was stated that "In pretensioned work, there are currently no known methods for epoxy coating the strands, and the potential for corrosion exists in a salt water environment as well as in areas where deicing chemicals are used."

There have been efforts to develop corrosion resistant PC tendons, and some are in use because nothing more efficient and/or more economical was available. Thus, the use of galvanized strand is often suggested by designers concerned about corrosion and not familiar with the properties of galvanized strands. Galvanized strands are not as strong as stress-relieved strands of the same size, and they cannot be fabricated so that they possess all of the desirable properties that are obtained by stress-relieving uncoated strands. They are appreciably more expensive per unit of strength, their bond properties are not consistent, and there can be a chemical reaction between the zinc coating and the cement paste in concrete. Although galvanized strands have been available since before the development of prestressed concrete, they are seldom used. Single unbonded posttensioned strands are used in the construction of flat slab floors for garages, apartment and office buildings, etc., and tendons made of several parallel wires are used in a similar manner. These tendons are typically coated with a corrosion resisting grease, encased in tubing, fastened in place and the concrete slab is cast around them. When the concrete has cured the tendon is tensioned and then permanently held under tension by an anchor at each end. At present, tendons of this type are being coated with grease and encased in plastic tubing. This is an improvement on the former paper wrap, but they are still subject to corrosion in the anchorage area because typically the tubing must be removed to permit the anchor to grip the strand. Additionally, the relatively thin plastic is sometimes damaged during handling.

Posttensioned grouted tendons have been in use as long as prestressed concrete itself. The tendon is threaded through a cavity that has been cast in the concrete, or the tendon is encased in an oversized flexible metal or other type of tube before concrete is cast. After the concrete is cured, the tendon is tensioned, and the cavity around the tendon is pumped full of liquid cement grout. The cavity can be filled if the tendon is properly detailed and fabricated, and if the grout is properly injected. In actual practice, this is frequently not the case, and areas susceptible to corrosion are left in the cavity.

In precast pretensioned members, the tendons typically are seven-wire strands which are tensioned and anchored in the forms. Concrete is cast around the strands. When the concrete has cured, the strands are released from their external anchors, and their prestressing force is transferred to the concrete by bond between the steel and the concrete. Thus, in such pretensioned PC tendons, there is a problem not only of corrosion protection, but also one of bond transfer between the pretensioned PC tendon and the concrete.

The patented technology is replete with various approaches to the problems of corrosion protection and/or bonding characteristics, including some incidental disclosures. For instance, Billner U.S. Pat. Nos. 2,319,105 and 2,414,011 mention thermoplastic or thermosetting coverings which will harden and effect a bond between the concrete body and its reinforcement. Simonsson U.S. Pat. Nos. 2,591,625 and 2,611,945 involve coatings including siliceous material. Wijard U.S. Pat. No. 3,030,664 discloses reinforcing elements provided with a coating comprising a suspension of a hydraulic cement and rubber in suitable proportions as to be converted by steam curing of the concrete into a hard strong layer having good adhesion to the reinforcing elements and the concrete, and supposedly serving also as a rust-protective film. Rice U.S. Pat. No. 3,293,811 discloses an epoxy resin coating on PC strand to protect against notching by serrated teeth carried by anchor wedges. Mager U.S. Pat. No. 3,377,757 relates to steel storage tanks prestressed by plastic coated tendons extending about the tank, the plastic coating being for the purpose of protecting the tendons from corrosion forces. Lang U.S. Pat. No. 3,513,609 relates to posttensioned type tendons, including one embodiment in which the tendon incorporates a curable plastic material such as an epoxy resin between the wire or strand and an outer plastic coating, the curable resin being cured while the wire is held under tension so as to anchor the wire to the outer plastic coating and thus to the concrete structure along the length of the wire. The curable resin initially provides a lubricating effect and, after curing, provides a bonding effect. Curing of the resin is by passing electric current through the core wire. Lang U.S. Pat. No. 3,579,931 is of the same substance. Scott U.S. Pat. No. 3,596,330 discloses a structural tensile member made of steel wire or like material provided with a sheath or coating of polypropylene or other impermeable corrosion resistant material. Lang U.S. Pat. No. 3,646,748 discloses a PC strand encased in a corrosion inhibitor, and encompassed by a seamless plastic jacket tightly covering the encased strand. Palm U.S. Pat. No. 3,755,003 discloses concrete reinforcing elements coated with a coating comprising a pulverulent metal in intimate mixture with the residue from a composition containing an organic component plus a hexavalent-chromium-providing substance. The coating is stated to provide corrosion resistance and enhanced adhesion for concrete to the coated element. Kitta U.S. Pat. No. 3,922,437 involves coating of PC strand with an inner resin layer and then with a lubricant-containing thermoplastic material, and mentions increased corrosion protection provided by the inner resin layer.

From the foregoing, it will be apparent that the problems to which the instant invention is directed are long-standing and important, and that various solutions and approaches have been proposed. However, to our knowledge, the solutions and advantages provided by the present invention are not known in or reasonably derivable from the prior art.

Generally in accordance with the invention, there are provided concrete strengthening members, particularly PC tendons having formed thereon a strongly adherent plastic coating which may be substantially impermeable for improved corrosion resistance, and/or which may have embedded therein abrasive or grit-form particles to provide improved bond with the concrete, and particularly to provide controllable bond transfer in PC tendons of the pretensioned type. While the basic thrust of the invention involves improving PC tendons, those aspects whereby an impermeable coating can be obtained while also controlling bond characteristics are considered, applicable also to conventional steel reinforcing bars wire reinforcement for use in pressure vessels, pipe or the like, or other members. The plastic coating preferably is applied electrostatically from an aerated cloud of charged particles of resin powder, and fusion bonded by heat. The abrasive preferably is applied by spraying during a viscous state of the heated resin at a time when the resin has become fusion bonded into an integral coating, and can be varied as to size and spacing density so as to control the surface condition and the bonding effect. Among features achievable by the invention in its various aspects are corrosion resistance under high tension, ductility of strand and coating, adherence of the coating, toughness of the coating, abrasion resistance of the coating, integrity of the coating under stress and bending angles (an important feature because of the packaging of strand in coil packs), controllable bond transfer, and desired coating thicknesses while retaining overriding control of bond characteristics. In keeping with the invention, three forms of improved PC strand may be provided. Thus, there may be provided a corrosion resistant strand designed primarily for posttensioning, utilizing only the plastic coating, where bond transfer is not a consideration. There may be provided also strand having greatly improved corrosion resistance, plus bond transfer characteristics equal to or exceeding bare strand, thus offering readily controllable bond transfer in a strand of good corrosion resistance. Thirdly, where corrosion resistance is not a major consideration, there may be provided strand of relatively modestly improved corrosion resistance, but with readily controllable bond transfer characteristics.

Before discussing exemplary preferred embodiments of the invention, it is believed in order to mention two known concepts or characteristics relating to prestressed concrete members, these being the "transfer length" and the "development length." In a typical precast, pretensioned PC member, the prestressing strands or wires are placed in the empty forms, stretched to a high tension and held at that tension by temporary anchors located beyond the ends of the forms. The forms are then filled with concrete which completely surrounds each tendon. When the concrete has cured to the required strength, the temporary anchors are removed, and the load in the tendon that was carried by the anchors is transferred to the member by bond between the tendon and the concrete. The tension in the tendon at the extreme end of the member is zero. Within the member the tendon is trying to contract to the zero load length that existed before it was stretched. Bond or adhesion between the surface of the tendon and the concrete prevents this. Since the unit strength of the bond between the tendon and the concrete is small with respect to the total load in the tendon, an appreciable length of contact between concrete and tendon is required to transfer the full load from tendon to concrete. The length of contact required to transfer the full load is called "transfer length." "Transfer length" can be defined as the distance from the end of the member to the point at which the full load in a fully bonded tendon has been transferred to the concrete. Transfer length is influenced by tendon size, shape, material and surface condition and by the consistency of the concrete placed around it. Tests on seven-wire strands with diameters up to and including one-half inch indicate no difference in transfer length for concrete strengths of 1700 psi to 5000 psi. The second concept or characteristic is known as "development length." When a pretensioned bonded prestressed concrete flexural member is loaded from its normal working load to ultimate flexural capacity, there is a large increase in the tension in the strand. As the tension in the strand increases, the length of strand required to transfer the tension to the concrete also increases. The length required to develop the tension which exists at the time of ultimate flexural failure is called the "development length." For an uncoated seven-wire strand, the development length is much greater than the transfer length. For a typical one-half inch diameter uncoated strand, the transfer length is computed to be approximately twenty-five inches, whereas the development length is approximately eighty inches. In most cases for a strand that is debonded at the end of the member, the development length becomes 160 inches. The size and number of strands in a particular member are frequently determined by the development length, and a more economical design can be achieved if the development length is shorter. It is probable that a much shorter development length can be obtained with a grit-coated strand in accordance with the invention.

DESCRIPTION OF PREFERRED EMBODIMENTS

In making improved tendons or other members in accordance with the invention, the process generally involves the sequential steps of cleaning the tendon, heating the tendon to a predetermined temperature, electrostatically coating the heated tendon in a fluidized bed, optional grit application during the gel phase of the plastic coating heated by the heated tendon, and quenching at a desired stage of curing of the plastic coating. The process preferably is a continuous one whereby tendon or strand passes from a pay-off sequentially through the various steps of the process to a take-up. Although not specifically necessary, the process line can include a known holiday detector, e.g., a sixty-seven one-half volt. DC holiday detector, as specified in the previously mentioned ASTM standard specifications. Such detection normally would occur at the last stage before take-up.

The cleaning step preferably is accomplished by passing the strand from the pay-off through a known ultrasonic washer and a rinse tank. This is a known manner of cleaning using well-known equipment. Abrasive blasting is unnecessary.

From the rinse tank, the strand passes through an induction heater where it is heated to a temperature determined by, inter alia, the fusion and curing characteristics of the plastic to be coated. Typically the strand is heated to between 350° F. and 550° F., preferably 400° F. to 450° F., so as to be at a temperature of approximately 400° F. to 410° F. when contacted by the resin powder.

The heated strand is contacted with the resin powder and coated electrostatically immediately after leaving the induction heater. Preferably this is accomplished by passing the heated strand through a coater to be coated by electrostatic fluidized bed powder deposition. This is a known coating technique using commercially available coating equipment. In this coating process, powder particles are aerated in a fluidizing chamber and are electrostatically charged by ionized air which passes through a porous plate at the base of the chamber. As the powder particles become charged, they repel each other and rise above the chamber, forming a cloud of charged particles. When the grounded strand or wire is conveyed through the cloud, the charged powder particles, because of their opposite potential, are attracted to the wire. The powder particles form a generally uniform coating, being more attracted to exposed areas than to those already insulated. Coating thickness is controlled by applied voltage to the charging media and exposure time to the cloud. A suitable commercially available coater is produced by Electrostatic Equipment Corporation, New Haven, Conn., U.S.A., designated as Model 700. The coater includes a powder management system for handling the resin powder.

A suitable resin coating powder is SCOTCHKOTE brand 213, produced by Minnesota Mining and Manufacturing Company, Saint Paul, Minn. This is a fusion bonded epoxy coating comprising a one-part heat curable, thermosetting powdered epoxy coating, known for use in providing corrosion protection of pipe, girth wells and concrete reinforcing bars. It is stated to have a gel time at 400° F. of 5–8 seconds. The cure schedule specifies a minimum time to quench of twenty-eight seconds for an application temperature of 450° F. to 463° F. However, for purposes of the instant invention, it is preferred that the epoxy not be fully cured, but rather that curing be limited to approximately eighty percent to ninety percent of final cure. Degree of cure can be approximated by solvent tests of the epoxy coating, and can be regulated by application temperature and time of quench. Although the SCOTCHKOTE 213 product is usable, we find that a somewhat longer gel time is desirable as giving better flow of the melted epoxy powder, thus helping to avoid the occurrence of pin holes or holidays. Gel time can be determined to some extent by the temperature of the wire at the time of application of the epoxy powder. Alternatively, epoxy powders having longer gel times are available, and good results have been obtained using an epoxy powder of Hysol Division of Dexter Corporation, having a gel time of approximately twenty seconds. In general, prolonging the gel time facilitates obtaining a somewhat thinner, but still impermeable, coating. For instance, acceptable corrosion-protective coatings of approximately thirty-five mils to forty-five mils have been obtained with a gel time of approximately seven seconds, whereas acceptable corrosion-protective coatings of approximately twenty-five mils thickness have been obtained using a product with an approximately twenty second gel time. In general, depending on the particular characteristics desired in the fusion bonded coating, it is considered that coating thicknesses of from ten mils to fifty mils are workable and obtainable.

The heated strand leaves the powder coater with its epoxy coating in a viscous state, ready to receive the optional grit. In general, the grit should be applied as soon as possible after the melted epoxy has flowed sufficiently to close all holidays, but while the viscosity is sufficient to prevent the grit from penetrating to the metal. The grit may be applied in a number of manners, but preferably it is applied by pneumatic spray guns, and four such spray guns oriented at 90° from each other have been found satisfactory. The spray force should be regulated in keeping with the particle sizes and the viscosity condition of the epoxy so as to partially, but firmly, embed the grit in the viscous epoxy, short of contact with the steel strand or the like, so as to minimize the possibility of creating flow paths for corrosive elements along the interfaces of the grit particles and the epoxy in which they are embedded. Preferably the particles should be only partially embedded, such that they will have exposed external surfaces to bond with the concrete. Grit sizes of from about seventy to about 200 mesh Standard Tyler Series have been found to be satisfactory, depending on the bond characteristics desired. The grit may be of any of various materials, including glass frit or beads, or sand. Of course, for strand where corrosion is not a major consideration, contact of the grit with the steel strand is not a consideration, and the epoxy coating may be only of such thickness as to firmly embed the grit for bond transfer purposes.

The coated strand, with or without applied grit, is then passed through a quench tank at the desired stage of curing of the epoxy, passes therefrom optionally through a spark tester to detect pin holes and holidays, and thence to the take-up.

Satisfactory products have been made using continuous line speeds of ten feet per minute to thirty feet per minute, and it is anticipated that line speeds up to 400 feet per minute are obtainable.

Especially in the case of PC strand, which typically is shipped in coil packs of long length, it is possible to vary the process during treatment of a single reel, so as to provide a coil having sections with different specified characteristics.

Although epoxies are the presently preferred coatings, other plastic resins can be used. It has been found that excellent corrosion resistance under high tension is obtainable by an epoxy coating. The coating is strongly adherent to the strand or other member, is tough, and firmly embeds the grit. It is of compatible ductility with PC strand and wire, as well as reinforcing bar material. It has good abrasion resistance, and good integrity under the conditions of stress and bending angles to be encountered. Bond transfer is easily satisfactorily controllable by varying grit size and density of application, and unlike conventional coated reinforcing bar, a coating thickness adequate to provide the desired corrosion resistance can be used without losing control of the bond characteristics, since the grit or abrasive readily compensates for the changed surface condition arising from the plastic coating. Indeed, the plastic coating with applied grit provides a new range of bond control or transfer length. The coated strand handles satisfactorily in shipping and in the field, and, for posttensioned strands that are to be grouted, avoids the problem of rust or corrosion before the grout is injected. Such strands are often exposed at the job site for a considerable time before being placed in the concrete structure. Furthermore, most specifications require that the tendons or strands be tensioned and grouted within seven days of placement in the concrete structure. This is often a severe handicap to the engineer specifying job procedure and to the contractor who cannot schedule his operation in the best manner.

It will be understood that the foregoing description of preferred embodiments of methods in accordance with the invention are exemplary, and are susceptible to variations and modifications. For instance, although electrostatic application of the resin powder in a fluidized bed is preferred, alternative methods of application include known electrostatic spray guns, liquid application methods, etc. The preferred embodiment is preferred because of its practicality, controllability, and superiority of product. Also, it is possible to powder coat the tendon unheated, and to fuse and cure the coating thereafter in curing ovens, although we consider this to be less practical and less effective.

Having thus described our invention, including preferred embodiments thereof, as required, we claim:

1. A high strength metal member suitable for prestressing concrete having an adherent coating of synthetic resin characterized in that the metal member is a flexible strand of high strength metal wires, having a core formed of one or more central core wires and a plurality of outer wires extending helically around said core, and that the synthetic resin coating is only partially cured to approximately 80% to 90% of complete cure and the curing having stopped, so that it is flexible but continuous and substantially impermeable and has the helical configuration of the external surface of the strand evident on the external surface of the coating; the coated strand being sufficiently flexible to be coiled and uncoiled while maintaining the integrity of said coating.

2. Coated strand as claimed in claim 1 characterized in that said coating is a thermosettable epoxy resin.

3. Coated strand as claimed in claim 2 characterized in that said coating is between 0.26 and 1.3 mm thick.

4. Coated strand as claimed in claim 2 characterized in that the coating is between 0.52 and 1.04 mm thick.

5. Coated strand as claimed in claim 1 characterized in that said coating has grit-form material partially embedded therein so as to be partially exposed at the external surface thereof with substantially none of the grit-form material penetrating to contact the strand.

6. Coated strand as claimed in claim 1 wherein said synthetic resin coating is comprised of fusible thermosettable resin powder.

7. A method of coating a high strength metal member comprising a flexible strand of high strength metal wires, having a core comprised of one or more central core wires and a plurality of outer wires extending helically around said core, the method being continuous and comprising the steps of:

passing the strand from a pay-off;

cleaning the strand;

heating the strand to a predetermined temperature;

applying a fusible synthetic resin powder to the strand;

quenching the applied coating to stop curing of said coating when it has partially cured to approximately 80% to 90% of complete cure; and, passing the quenched coated strand to a take-up reel and coiling it thereon while maintaining the integrity of the coating.

8. A method as claimed in claim 7 wherein the powder is applied electrostatically and the coating is quenched before it is fully cured.

9. A method as claimed in claim 7 wherein said fusible synthetic resin powder is a thermosettable epoxy resin and characterized in that the time period between application of the powder to the heated strand and quenching is controlled to limit said curing.

10. A method as claimed in claim 7 characterized in that grit-form material is applied to the coating prior to quenching, the force of application being controlled so as to partially embed grit-form material in the coating such that grit-form material is exposed at the external surface of the coating but substantially none penetrates to contact the strand.

11. A method as claimed in claim 7 characterized in that the coated strand is packed in coil packs for shipment.

12. Corrosion resistant coated metal strand, said metal strand having a core formed of one or more central core members and having one or more outer metal wires extending in the form of a helix around said core, a coating comprised of a heat curable resin encasing said metal strand, said coating being only partially cured to approximately 80% to 90% of complete cure and the curing having stopped, said strand and coating having sufficient flexibility to be coiled and uncoiled while maintaining the integrity of said coating.

13. Metal strand as defined in claim 12 wherein said coating has a thickness in the range of 10 to 50 mils and the configuration of said helix is evident on the external surface of said coating.

14. Metal strand as defined in claim 12 wherein said coating has grit-form material partially but firmly embedded therein so as to be partially exposed at an external surface of said coating with substantially none of the grit-form material penetrating to contact said strand.

15. Metal strand as defined in claim 12 wherein said resin is comprised of a heat curable thermosettable epoxy resin.

16. Metal strand as defined in claim 12 wherein said coating has a thickness in the range of 10 to 50 mils and the configuration of said helix is evident on the external surface of said coating; said coating having grit-form material partially but firmly embedded therein so as to be partially exposed at an external surface of said coating with substantially none of the grit-form material penetrating to contact said strand; said resin being comprised of a heat curable thermosettable epoxy resin.

* * * * *